US006007268A

United States Patent [19]

Whittington et al.

[11] Patent Number: 6,007,268

[45] Date of Patent: Dec. 28, 1999

[54] RADIAL AND AXIAL LOCKING RELEASE COLLAR

[75] Inventors: Neil Whittington, Danielson, Conn.; William Mueller, Grafton, Mass.

[73] Assignee: Specialized Marketing International, Inc., Wauregan, Conn.

[21] Appl. No.: 09/066,195

[22] Filed: Apr. 24, 1998

[51] Int. Cl.[6] ..... A63B 13/00

[52] U.S. Cl. ..... 403/328; 403/110; 403/348; 403/379.1; 482/107

[58] Field of Search ..... 403/109.1, 110, 403/325, 328, 379.1, 348; 482/107, 106

[56] References Cited

U.S. PATENT DOCUMENTS

| | | | |
|---|---|---|---|
| 4,485,845 | 12/1984 | Brady . | |
| 4,775,269 | 10/1988 | Brix . | |
| 4,893,810 | 1/1990 | Lee . | |
| 4,901,836 | 2/1990 | Stenmark et al. | 403/328 X |
| 5,013,194 | 5/1991 | Weinhold . | |
| 5,024,434 | 6/1991 | Smith . | |
| 5,141,355 | 8/1992 | Stillwagon | 403/325 |
| 5,163,887 | 11/1992 | Hatch . | |
| 5,295,934 | 3/1994 | Collins et al. | 482/107 |
| 5,573,255 | 11/1996 | Salpaka . | |
| 5,601,380 | 2/1997 | Guthrie et al. . | |

*Primary Examiner*—Lynne H. Browne
*Assistant Examiner*—John R. Cottingham
*Attorney, Agent, or Firm*—Samuels, Gauthier & Stevens

[57] ABSTRACT

An axial and radial locking release collar adapted to be axially received on and to be removably fixed at any selected location along the length of an elongated shaft and radially locked in at least one direction around the shaft. The release collar includes an axially movable sleeve. Moveable balls are cammed into frictional engagement with the shaft. A tension ring includes angled segments removed from the inner surface thereof such that said movable balls are held in the angled segments to prevent radially movement around the shaft. The release collar may also be easily slid onto a threaded shaft and locked into place.

21 Claims, 6 Drawing Sheets

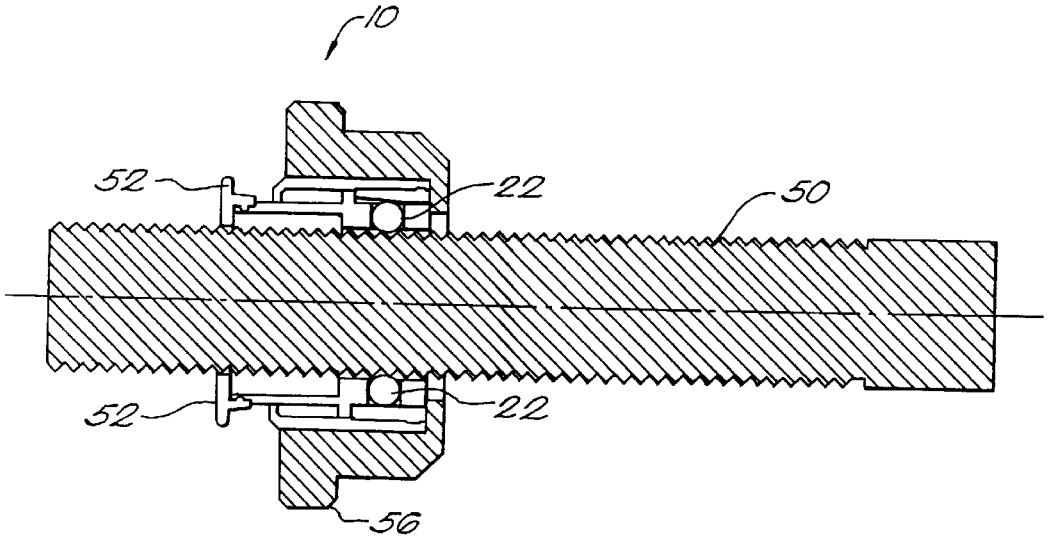
FIG. 4
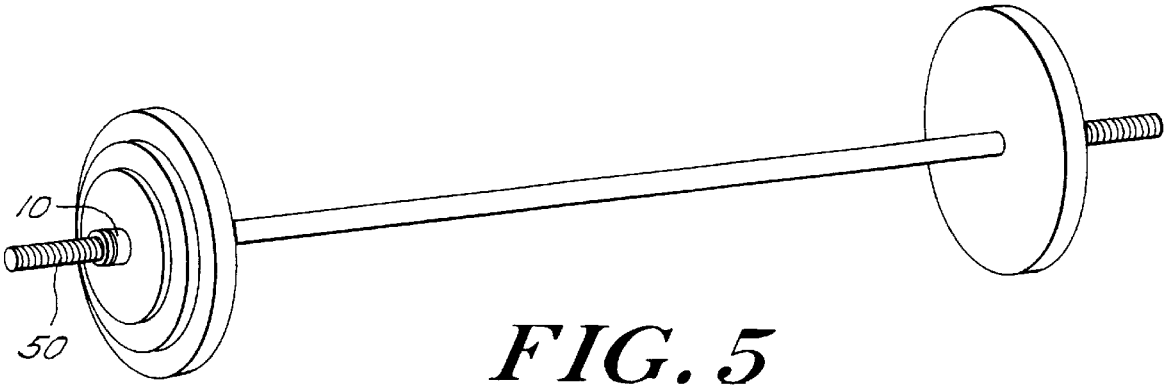
FIG. 5
FIG. 6B
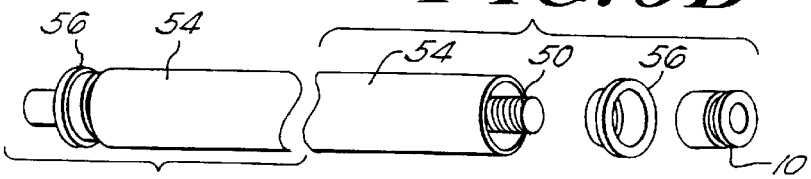
FIG. 6A

RADIAL AND AXIAL LOCKING RELEASE COLLAR

BACKGROUND OF THE INVENTION

Release collars have a wide variety of applications. For example they have been used to retain weight plates on barbells, for tools such as retaining saw blades in place, hand held tools with removable chucks, telescoping devises such as drafting tables, beach umbrellas, etc, wheels on tables, toys and the like, etc. These collars may lock axially and radially on a bar, shaft, etc.

U.S. Pat. No. 4,893,810 discloses a quick release collar for a weight lifting barbell. Specifically, it describes a release collar which includes a housing and an inner mechanism. The housing includes an inner body, an outer sleeve and an end release ring. The inner mechanism is comprised of three steel balls, a tension ring having a tapered inner diameter and a spring. The inner body includes three openings such that the three balls extend through the inner diameter of the inner body and are also adjacent the tapered tension ring. When the collar is placed around a shaft with the same size outer diameter as the collar's bore, the bearings lock by squeezing against the shaft and the tension ring. This locks the collar in place. The housing parts are spring loaded to facilitate placement and removal of the collar body on the shaft. To release the collar body, the inner body is pulled back through the inside of the outer sleeve, withdrawing the ball bearings out of the gap between the inner body and the shaft and thus release the collar's hold on the shaft. The spring forces the inner body back to the closed position.

Some of the other prior art release collars include the use of a grooved bar or shaft, a squared bar or shaft, set positions in the collar such that in which balls drop in to lock, thus requiring both a male and female interlocking pieces, etc.

Additionally there are some release collars which will lock both radially and axially, however these are not easy to use. For instance to prevent radial movement with one collar, one must use an allen wrench to tighten down a set screw onto a shaft. The set screw must be precisely locked onto the shaft. This locking procedure can involve some tricky manipulation. If the set screws are not properly set, the parts can fly off, jamming machines, cause injuries, etc.

Release collars are often used with devices/apparatus which require one to repeatedly place the release collars on a shaft and then remove the same. For instance the changing of the weight plates on the barbells, or bits in a hand-held tool such as a drill. Thus, the release collars must be easy to establish in place along the shaft and also fairly easy to remove. On the other hand, the release collars are often used with dangerous or heavy pieces of equipment such as weight plates, saws, drills, etc. and thus they must reliably maintain their position on the shaft.

A general objective of the present invention is to provide an improved quick release collar/fastener which locks both radially and axially thus preventing the collar from spinning off of a rotating or non-rotating shaft.

Another object of the invention is to provide a release collar that can be tighten down onto a threaded shaft and locked in place both axially and radially.

Still another objective of the invention is to provide a release collar that radially locks in one or both directions i.e. clockwise or counterclockwise.

Yet still another objective of the present invention is to provide a radial release collar to secure and adjust rollers on conveyors, automation assembly line, labeling machines, etc.

A companion objective of the present invention is to provide a release collar that will lock axially in two directions and also radially in both directions.

Another objective of the present invention is to provide a release collar which locks radially and axially on a spinning shaft and is further releasable without the use of a tool to position the collar or dislodge or detach the collar.

Still another object of the invention is to provide a release collar that may be locked onto a threaded shaft and then released by releasing the collar mechanism.

SUMMARY OF THE INVENTION

Broadly speaking, the present invention is directed to a quick release collar for mounting on a shaft and will lock both axially and radially on the shaft. The release collar is adapted to be axially received on and to be removably fixed at any selected location along the length of an elongated shaft and radially and axially locked in at least one direction around the shaft. The release collar includes an axially movable body having movable balls located in holes of the body. A tension ring includes angled recesses along the inner surface thereof such that the movable balls are frictionally maintained in the angled recesses to prevent radially movement around the shaft.

An alternative embodiment is directed to a quick release collar which easily slides onto a threaded shaft. Once on the shaft, the release collar is turned slightly to tighten the collar in place and to lock axially onto the threaded shaft. The release collar includes at least three ball bearings in the body of the collar. Each of the ball bearings are located on separate planes of the movable body. The ball bearings may all be the same size or each may be of a different size.

BRIEF DESCRIPTION OF THE DRAWINGS

FIG. 4 is a cross-sectional view of a release collar of the present invention in the locked position on a threaded shaft;

FIG. 5 is a perspective view of the release collar in the locked position on a threaded shaft of weight lifting apparatus;

FIG. 6A is a perspective view of a release collar of the present invention in the locked position located on a threaded shaft of a textile supply package;

FIG. 6B is a telescopic view of a release collar of the present invention before being positioned on a threaded shaft of a textile supply package;

DETAILED DESCRIPTION OF PREFERRED EMBODIMENT

Figure 1:
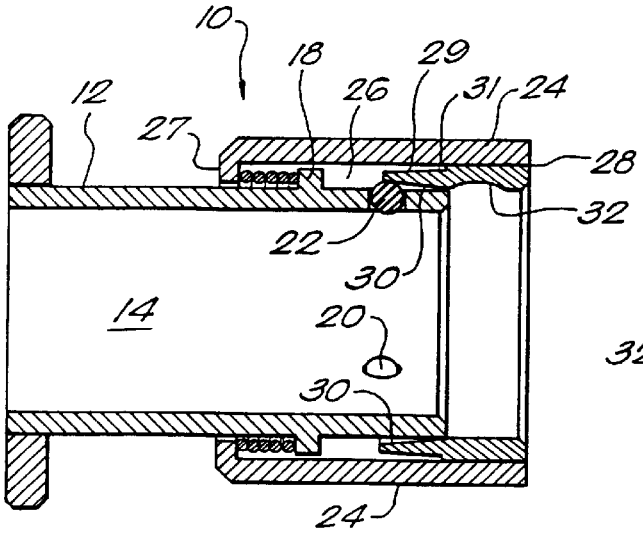
FIG. 1 is a cross-sectional view of a release collar of the present invention in the locked position.
Figure 2A:
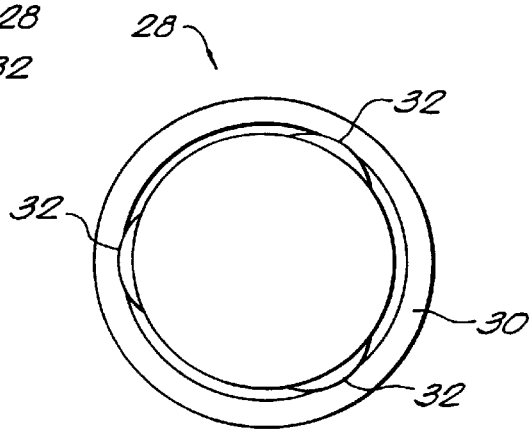
FIG. 2A is an end view of the tension ring.
Figure 2B:
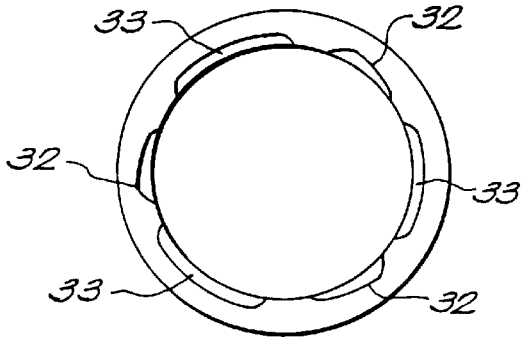
FIG. 2B is an end view of alternative embodiment of the tension ring.
Figure 3:
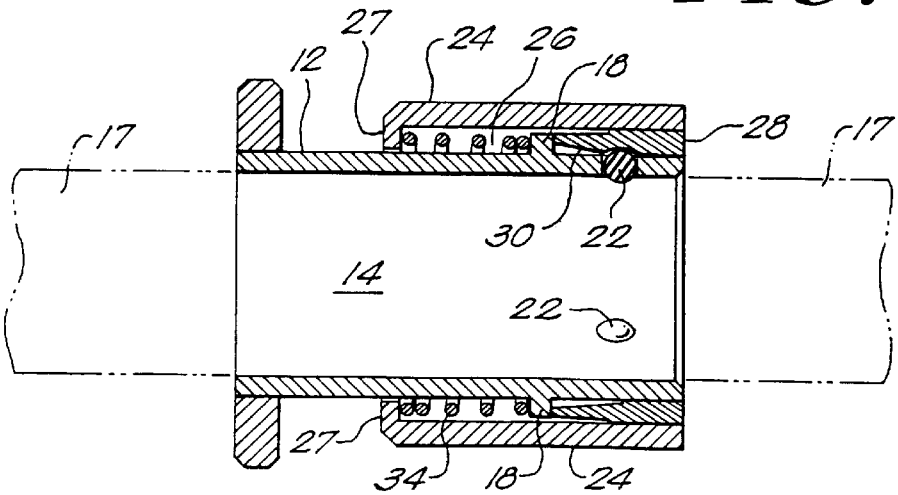
FIG. 3 is a cross-sectional view of a release collar of the present invention in the unlocked position.

With reference to FIGS. 1–3, a release collar 10 is shown in accordance with the present invention. Specifically an axial and radial locking release collar is adapted to be axially received on and to be removably fixed at any selected location along the length of an elongated element such as a bar or a shaft. The elongated element may be of any shape such as round, square, etc. The release collar 10 includes a collar body 12 having an axially extending passage 14 extending therethrough for receiving a shaft 17. A radially outwardly extending first flange 18 is on the outer surface of the collar body. The collar body also includes a plurality of radial openings 20. The openings 20 may be in the same or different planes, and may be of the same or different sizes. Typically there are three balls bearings located within the openings 20 in the collar body 12. However, the collar is functional with only two ball bearings or may include more than three ball bearings or may even include two sets of bearings, each set including three ball bearings. A sleeve 24 surrounds the collar body 12 and defines a space 26 therebetween. The sleeve 24 includes a second flange 27 extending radially inwardly toward the collar body 12 at a location spaced axially from the first flange 18.

A tension ring 28 is integrally associated with and is surrounded by the sleeve 24. The tension ring 28 is located in the space 26 between the sleeve 24 and the collar body 12. The sleeve 24 and the tension ring 28 are axially slidable as a unit with respect to the collar body 12 between a locked position and an unlocked position. Additionally the tension ring 28 may have an end portion 29 with a tapered inner surface 30. The tapered inner surface 30 includes a relatively small dimensioned segment 32 which urges the movable balls 22 radially inwardly into the passage 26 in the locked position, and having a relatively large dimensioned segment accommodating radial movement of the movable balls out of the passage in the unlocked position. Along the outer circumference of the tension ring is an undercut 29. This allows the end portion 29 to flex outward during vibration or shock, thus minimizing any amount of deformation to the shaft 17.

The tension ring 28 further includes angled recesses 32 along the inner surface thereof. At least one portion of the angled recesses 32 should overlap the tapered inner surface 30 of the tension ring 28. When the release collar 10 is positioned in the locked position on the shaft, and rotational or axial force is applied to the collar 10, the ball bearings 22 dig into the shaft and the tension ring 28 causes a camming or gripping action to preventing rotation of the release collar 10 around the shaft 17.

The angled recesses 32 prevent rotation in one direction, to prevent rotation in the opposite direction a second set of angle recesses would have to be included on the inside surface of the tension ring, and additional ball bearings may have to be included in holes along the collar body surface. The second set of recesses would have opposite angles from the first set of recesses. As see in FIG. 2A the angled recesses are angle from left to right which will prevent rotation in the clockwise direction and the angled recesses in FIG. 2B will prevent rotation in a counterclockwise direction as they are angled from right to left. Also the angled recesses are cut through the angled portion 30 in FIG. 2A. FIG. 2B also includes recesses 33 which are angled in the axial direction of the tension ring 28 to prevent axial movement of the fastener.

Biasing means which may be a spring 34 is positioned in the space between the first and second flanges 18, 26 for normally biasing the sleeve 24 and the tension ring 28 axially with resect to the collar body 12 toward the locked position. The tension ring 28 and the first flange 18 are coactively engageable to limit the extent of movement of the sleeve 24 and the tension ring 28 toward the locked position.

Because the release collar prevents radial movement along a shaft, the release collar may be used on a spinning shaft, non-spinning shaft, an application where the object being held in place rubs against the collar, pressed into a gear or used to drive an object. Additionally the release collar maybe used to secure and adjust rollers on conveyors or automation assembly lines, reels, spools, bobbins, supply packages, adjusting guide pulleys, gears, etc. As the release collars are relatively easily and quickly adjusted, the set-up time and changing time is greatly reduced over prior art devises which require the use of a tool to remove or disconnect the device.

There are many ways to vary the gripping or holding forces of the collar on the shaft. For example the collar may include 2 sets of ball bearings, each set may be of a different size. The larger bearings would be adjacent to the tapered portion of the tension rings. Another method to change the holding force of the collar would be to alter the shape, hardness, coefficient of friction and dimensions of the angled recesses. Other variations occur when the material of the ball bearings is modified from a metal such as steel, to rubber, a polymeric material such as plastic, carbide etc. The number of ball bearings may be changed, along with the material hardness, coefficient of friction or even the shape of the bearing such as using gnarled, oval or pin type bearings.

Also the collar and housing may be a polymeric material such as acrylonitrile butadiene styrene known as "ABS" but may also be made from a metal such as steel. Additionally the shaft material, size, hardness and coefficient of friction would also effect the holding force of the release collar on the shaft.

The spring mechanism is also important and can change the holding action of the collar on the shaft. Specifically the holding action can be altered by adjusting the spring tension, wire diameter, material and overall dimensions.

The tension ring may be made of metal such as steel, polymeric material such as plastic, carbide, etc. To alter the effective holding ability of the release collar the size, shape, angle, etc of the grooves may be modified or the hardness and coefficient of friction of the tension ring material may be altered. Additionally the holding force of the collar may be modified by the angle of the tapered portion of the tension ring, the depth and/or length of the undercut, the percentage or degree of flex in the end portion of the tension ring or the position of the ball bearings along the tension ring. The end position of the tension ring can also be manufactured to actually break off or what is known as break away when the pressure on the end portion becomes too great.

Figure 7:
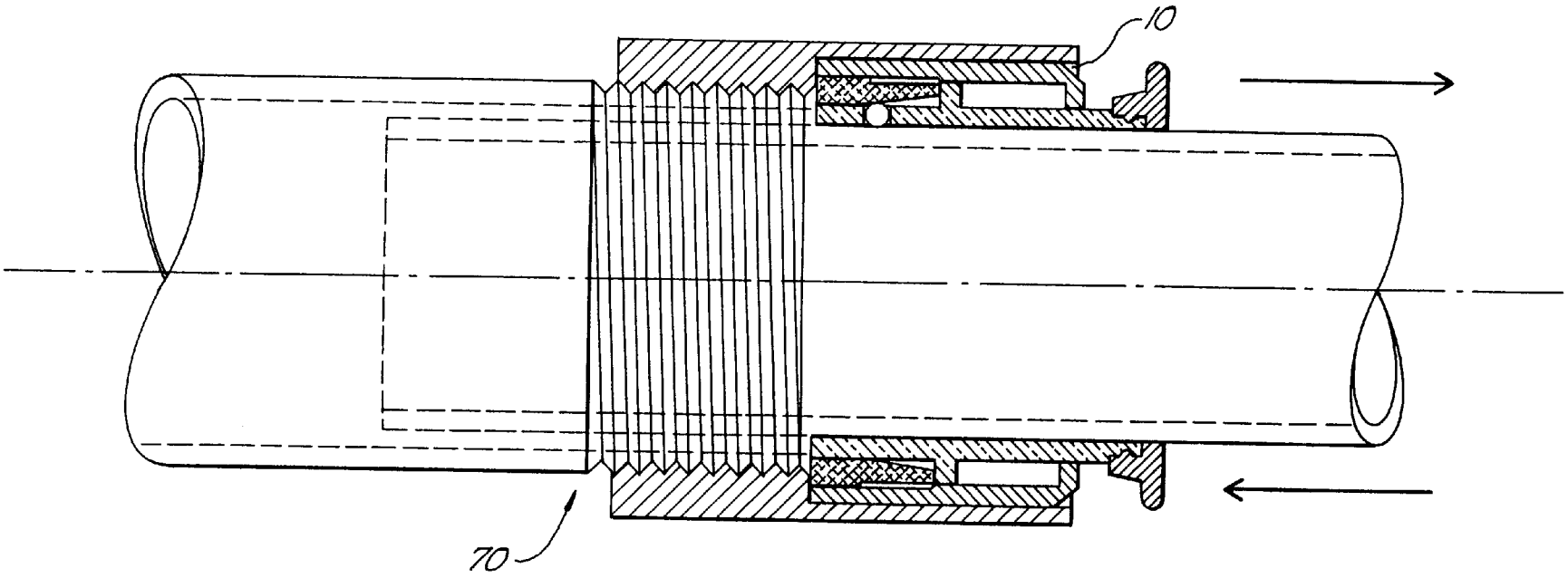
FIG. 7 is a cross-sectional view of a release collar of the present invention on a telescopic pole assembly.
Figure 8:
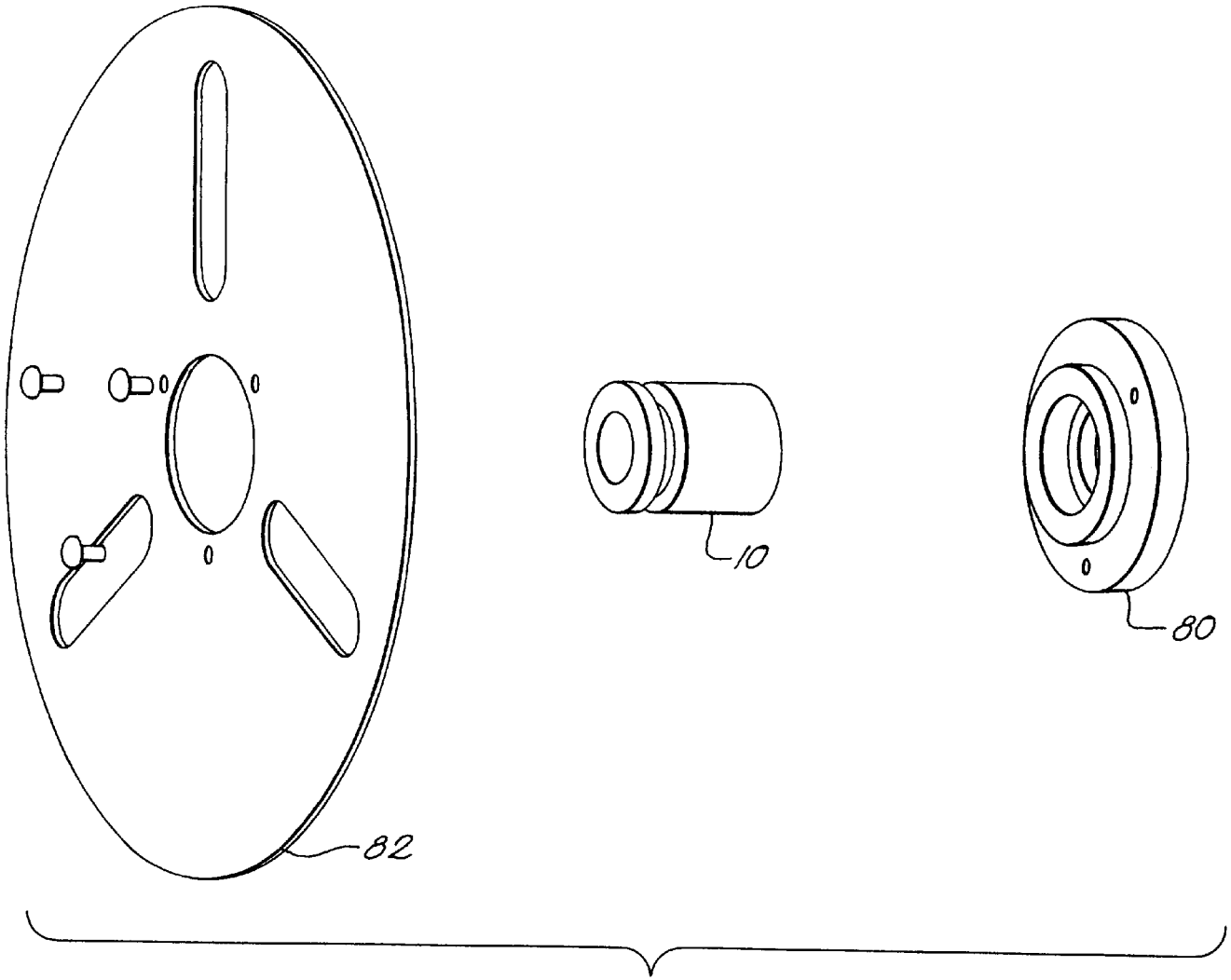
FIG. 8 is a telescopic view of a release collar of the present invention before being positioned in a hub assembly.

As seen in FIG. 7, the release collar 10 may be used in a telescopic pole assembly 70 to adjust the height of the pole assembly. Additionally as seen in FIG. 8 the release collar 10 can be pressed into a hub assembly including an outer hub 80 and a disk 82. The hub assembly may be utilized in the labeling industry. The collar allows for the elimination of the reels in the labeling equipment as well as aligning material during take up or payoff.

An alternative embodiment includes the use of the release collar 10 on a threaded shaft 50, see FIG. 4. Currently, if a release collar is used on a threaded shaft it must be used with a screw and nut or a thread nut. Additionally the collar would be hand spun down the threaded shaft or would require a tool to accomplish the same. With the claimed invention, the release collar 10 would slide freely down the threaded shaft 50 and automatically locking in the opposite direction from where it stopped. When the collar 10 reaches the desired position on the threaded shaft 50, gripping means 52 automatically locks. The collar 10 would then need about a half turn to tightened the collar against an object being held on the shaft.

More specifically, there are at least three ball bearings 22 in the collar body 12 when used in conjunction with a rounded collar whereas as a square collar uses two ball bearings (not shown). Each of the bearings 22 are of different sizes and are in a different plane, such as on a thread of a nut or bolt. The collar 10 slides freely onto the threaded shaft 50 and locks and tightens down like a threaded nut. The ball bearings 22 are guided within the groove of the thread. To release the collar 10, the collar is twisted in the reverse direction from when it was tightened on the shaft 50, i.e. about one turn to slightly loosen the collar away from the secured object on the shaft and or the threaded shaft and then the release mechanism of the collar is cammed to freely slide the collar off of the shaft.

This type of mechanism could be used on a threaded shaft/bar of a weight lifting apparatus, see FIG. 5. Or the mechanism could be used in the textile industry to hold supply packages 54 on creels payoff systems, see FIGS. 6A and 6B or any threaded bolt/fastener. For example, the collar could be pressed into a cap, cone or core chuck 56 of the supply packages 54 to create one unit as also shown in FIG. 4. The cap 56 and collar 10 would be slid over the threaded shaft 50 until the cap rested in the supply package. The collar 10 is given one final half turn to tighten the unit i.e. the cap 56 and collar 10, in place. The use of this type of collar would also save on setup and replacement time and reduce carpal tunnel syndrome as one would not be constantly spinning a collar or threaded nut along a threaded shaft.

Figure 9:
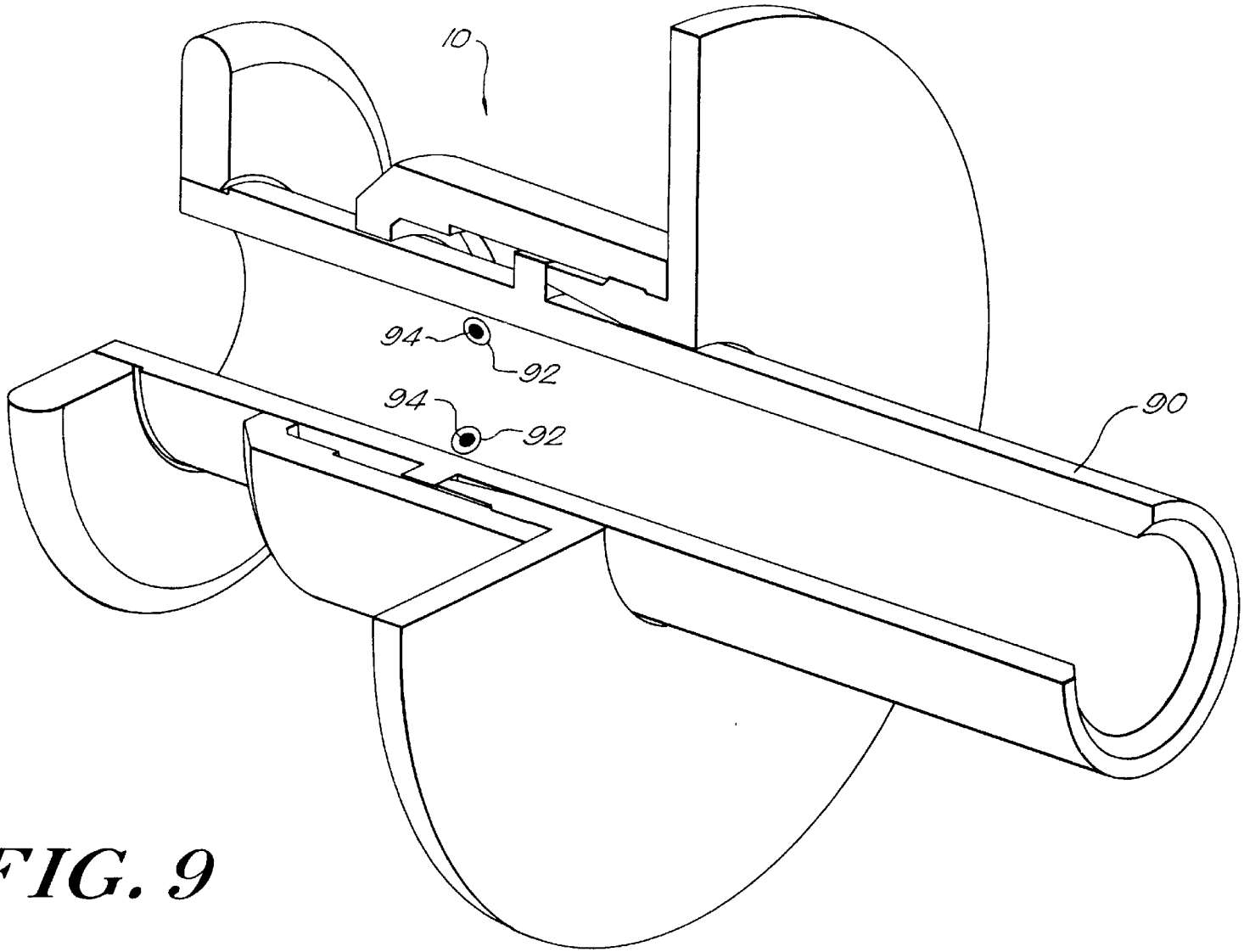
FIG. 9 is a cut-away view of a release collar of the present invention used on a symbol stand.
Figure 10:
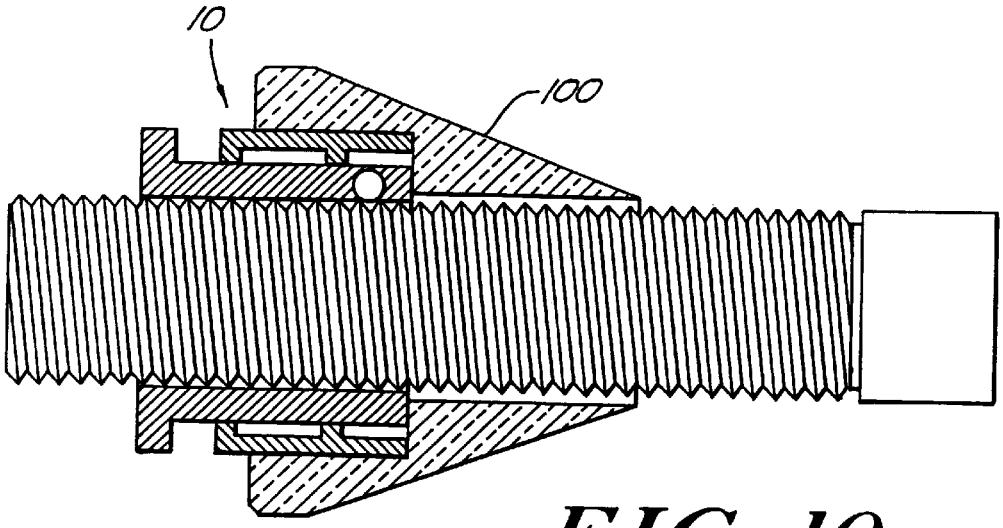
FIG. 10 is a cross-section of a release collar of the present invention pressing into a cone design.

Additionally the collar can be used on a symbol stand as seen in FIG. 9. The collar includes a tube 90 which can be placed over a threaded shaft of a cymbal stand and locked into place. The tube includes holes 92 in separate planes through which the ball bearings 94 emerge. The collar can also be pressed into a core cone 100 as seen in FIG. 10 and as used similarly to that described above with the core chuck.

The above listed methods of altering the holding force in the radially locking release collar would also apply to the threaded shaft, including varying the material of the bearings along with their size and shape, etc.

Figure 11:
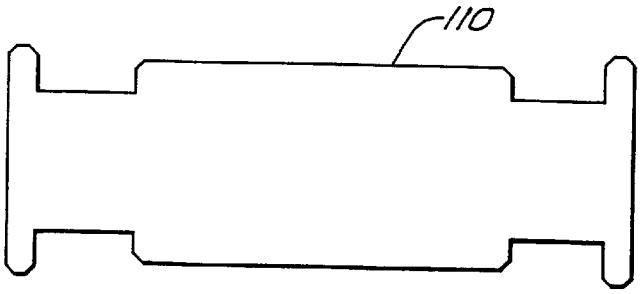
FIG. 11 is a double release collar of the present invention.
Figure 12:
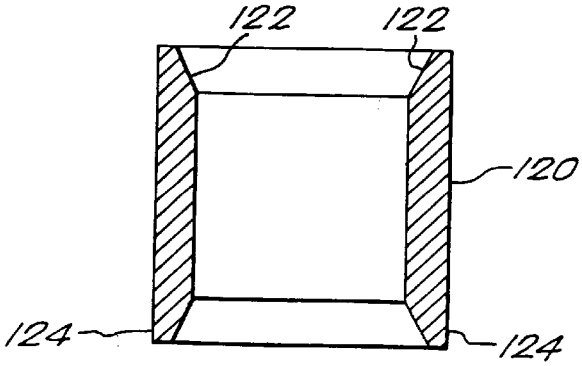
FIG. 12 is a cross-sectional view of the release collar used in a double release collar.

Alternatively as seen in FIG. 11 the release collar 110 may be made to look like two release collars placed back to back. This would allow the collar 110 to be placed on a shaft and when one wanted the collar to be moved to the left, the left release mechanism would be used and the right release mechanism would be used to move the collar to the right. FIG. 12 illustrated the tension ring 120 which may be used in the double release collar. The tension ring includes two tapered portions 122, 124. The tension ring may or may not include the angled recesses to radially lock the collar.

Having illustrated the present invention, those skilled in the art will realize many variations are possible which will still be within the scope and spirit of the claimed invention.

What is now claimed is:

1. An axial and radial locking release fastener adapted to be axially received on and to be removably fixed at any selected location along the length of an elongated element, comprising:

a collar body having an axially extending passage extending therethrough for receiving said element, said collar body includes opening therethrough;

radially movable balls located within the openings of said collar body;

a sleeve surrounding said collar body and defining a space therebetween;

a tension ring integrally associated with and surrounded by said sleeve, said tension ring being located in the space between said sleeve and said collar body, said sleeve and said tension ring being axially slidable as a unit with respect to said collar body between a locked position and an unlocked position, said tension ring having an end portion with a tapered inner surface, said tapered inner surface having a relatively small dimensioned segment which urges said movable balls radially inwardly into said passage in the locked position, and having a relatively large dimensioned segment accommodating radial movement of said movable balls out of said passage in the unlocked position; said tension ring further comprising angled recesses coinciding with at least a portion of the tapered inner surface of said tension ring, such that when rotational force is applied to said fastener about the elongated body, said movable balls are cammed against the shaft thus preventing said release fastener from rotating about the elongated element; and release means to allow the fastener to be unlocked and moved along the length of the elongated element.

2. The axial and radial locking release fastener of claim 1, wherein said recesses of said tension ring are angled left to right.

3. The axial and radial locking release fastener of claim 1, wherein said recesses of said tension ring are angled right to left.

4. The axial and radial locking release fastener of claim 1, wherein said tension ring includes two sets of recesses each set angled in opposite directions.

5. The axial and radial locking release fastener of claim 1, wherein said movable balls are of different sizes.

6. The axial and radial locking release fastener of claim 1, wherein said movable balls are the same size.

7. The axial and radial locking release fastener of claim 1, wherein said movable balls are pins.

8. The axial and radial locking release fastener of claim 1, wherein said movable balls are made of metal, rubber or a polymeric material.

9. The axial and radial locking release fastener of claim 1, wherein said movable balls are gnarled.

10. The axial and radial locking release fastener of claim 1, wherein the inner surface of said tension ring is rough or gnarled.

11. The axial and radial locking release fastener of claim 1, wherein said release fastener includes two sets of movable balls.

12. The axial and radial locking release fastener of claim 11, wherein said two sets of movable balls are each of a different size.

13. The axial and radial locking release fastener of claim 1, wherein the fastener is used with a telescopic pole and may be used to adjust the height thereof.

14. The axial and radial locking release fastener of claim 1, wherein the fastener is pressed into a hub assembly.

15. An axial and radial locking release fastener adapted to be axially received on and to be removably fixed at any selected location along the length of an elongated threaded element, comprising:

a collar body having an axially extending passage extending therethrough for receiving said element, wherein said collar body having a first end to receive said element, and a plurality of radial openings in said collar body, each opening being positioned along a different plane;

radially movable balls located within the openings in said collar body, each ball being of a different size, such that said smallest ball is nearest to said first end of said fastener;

a sleeve surrounding said collar body and defining a space therebetween;

a tension ring integrally associated with and surrounded by said sleeve, said tension ring being located in the space between said sleeve and said collar body, said sleeve and said tension ring being axially slidable as a unit with respect to said collar body between a locked position and an unlocked position, said tension ring having an end portion with a tapered inner surface, said tapered inner surface having a relatively small dimensioned segment which urges said movable balls radially inwardly into said passage in the locked position, and having a relatively large dimensioned segment accommodating radial movement of said movable balls out of said passage in the unlocked position; and release means to allow the fastener to be unlocked and moved along the length of the elongated element.

16. The axial and radial locking release fastener of claim 15, wherein said movable balls are made of metal, rubber or a polymeric material.

17. The axial and radial locking release fastener of claim 15, wherein said movable balls are gnarled.

18. The axial and radial locking release fastener of claim 15, wherein the inner surface of said tension ring is rough or gnarled.

19. The release fastener of claim 15, wherein the fastener is pressed into a core chuck, cap, or cone.

20. The release fastener of claim 15, wherein the fastener includes a tube through the center of said fastener such that said tube can be placed over a threaded shaft and locked in place.

21. An release fastener adapted to be axially received on and to be removably fixed at any selected location along the length of an elongated element, comprising:

a collar body having an axially extending passage extending therethrough for receiving said element, said collar body has openings therethrough;

radially movable balls located within the openings of said collar body;

a sleeve surrounding said collar body and defining two spaces therebetween;

a tension ring integrally associated with and surrounded by said sleeve, said tension ring being located in the space between said sleeve and said collar body, said sleeve and said tension ring being axially slidable as a unit with respect to said collar body between a locked position and an unlocked position, said tension ring having two end portions each with a tapered inner surface, said tapered inner surfaces having relatively small dimensioned segment which urges said movable balls radially inwardly into said passage in the locked position, and having a relatively large dimensioned segment accommodating radial movement of said movable balls out of said passage in the unlocked position; and two release means, one at each end of said collar body, each release means to release the fastener in one direction along the elongated element.

* * * * *